US005178494A

United States Patent [19]

Zitz et al.

[11] Patent Number: 5,178,494

[45] Date of Patent: Jan. 12, 1993

[54] ROOF SUPPORT FOR UNDERGROUND EXCAVATIONS SUCH AS COAL MINES

[75] Inventors: Alfred Zitz, Zeltweg; Karl Lerchbaum, Fohnsdorf; Heinrich Suessenbeck, Zeltweg, all of Austria

[73] Assignee: Voest-Alpine Bergtechnik Gesellschaft m.b.H., Zeltweg, Austria

[21] Appl. No.: 766,358

[22] Filed: Sep. 26, 1991

[30] Foreign Application Priority Data

Sep. 26, 1990 [AT] Austria ..... 1946/90

[51] Int. Cl.[5] ..... E21D 15/44

[52] U.S. Cl. ..... 405/290; 405/291; 405/299; 248/548

[58] Field of Search ..... 248/542-548; 405/290, 291, 292, 293, 294, 295, 296, 297

[56] References Cited

U.S. PATENT DOCUMENTS

| | | | |
|---|---|---|---|
| 4,140,430 | 2/1979 | Blumenthal et al. | 405/291 |
| 4,915,540 | 4/1990 | Kennedy et al. | 248/548 X |

FOREIGN PATENT DOCUMENTS

| | | | |
|---|---|---|---|
| 379215 | 12/1985 | Austria . | |
| 1907221 | 8/1970 | Fed. Rep. of Germany | 405/297 |
| 3715716 | 11/1988 | Fed. Rep. of Germany . | |
| 3818725 | 12/1988 | Fed. Rep. of Germany . | |
| 976086 | 11/1982 | U.S.S.R. . | |
| 1320428 | 6/1987 | U.S.S.R. . | |
| 1343024 | 10/1987 | U.S.S.R. . | |
| 370554 | 4/1932 | United Kingdom | 248/548 |
| 2099040 | 12/1982 | United Kingdom . | |

*Primary Examiner*—Randolph A. Reese
*Assistant Examiner*—Arlen L. Olsen
*Attorney, Agent, or Firm*—Cushman, Darby & Cushman

[57] ABSTRACT

A roof support for the ceilings of excavated spaces underground and particularly for supporting caving edges for pillar recovery in coal mines is described. The roof support has a roof bar connected to a base frame by hydraulically extendable props and by a lemniscate mechanism. The props are articulated to the base frame and to the roof bar. A link of the lemniscate mechanism has a predetermined bending point. Since this link fails when overloaded before the remainder of the apparatus, it is the only element that need be replaced when the apparatus is overloaded. Thus, the device may be economically repaired.

8 Claims, 2 Drawing Sheets

ROOF SUPPORT FOR UNDERGROUND EXCAVATIONS SUCH AS COAL MINES

The invention relates to a roof support for supporting the roof and shielding the caving areas of underground excavations, and particularly for waste-edge support when pillars are being extracted in coal mines. The support comprises a roof bar, which is braced against a base frame by means of hydraulically extendable props and a lemniscate mechanism. The props are articulated to the base frame and to the roof bar.

BACKGROUND OF THE INVENTION

A roof support of this type is found, for example, in AT-PS 379 215. In roof supports of this type, the lemniscate mechanism works in such a way that when the roof bar is being raised, it moves in a largely vertical direction. In roof supports of this type, the principle of arranging the props at an angle to one another with, e.g., four props being used to connect the base frame to the roof bar, is known in the art. Such roof supports can be moved on runners or caterpillar tracks, for example. When these roof supports are used in room-and-pillar coal-mining, they have to support high roofs, and therefore under unfavorable load conditions the lemniscate mechanism has to cope with great lateral forces. Particularly with fully extended props and very high roofs, such lateral forces can cause overloading of the lemniscate mechanism, leading subsequently to the need for extensive repair work, with the entire lemniscate mechanism having to be completely replaced.

SUMMARY OF THE INVENTION

The present invention aims to create a roof support of the above-mentioned type that can be restored to working order at low cost, even after it has been subjected to strong lateral forces, or to overload conditions due to bumps or rock bursts. To achieve this aim, the roof-support of the present invention incorporates an improvement in that a predetermined bending point is provided on at least one of the links of the lemniscate mechanism. Since at least one of the links of the lemniscate mechanism has a predetermined bending point on it, a certain degree of plastic deformation is thus permitted for the absorption of excessive loads, and in extreme cases the worst that can happen is that one of the links needs to be replaced, without the entire lemniscate mechanism having to be replaced as well. In addition to this, such a bending point can be dimensioned so that even when overloaded, it still provides a certain measure of safety in the way it deforms at the predetermined bending point. In particular, with such a bending point, the geometry of the linkage system and of the support provided by the props can be designed so as to permit lateral slewing within a predetermined range of, for example, $\pm 6°$. Such lateral slewing, caused by roof falls, can be controlled by hydraulically controlled link joints. Only when this permissible slewing range is exceeded does the danger of uncontrollable deformation of the individual structural components arise in prior art designs, and this can be brought under safe control by providing a predetermined bending point on at least one of the links of the lemniscate mechanism. In this case, any deformation of said link when the maximum permissible roof load has been exceeded can be readily observed, so that when a bend occurs in such a link it can be easily replaced, because deformation of the other components of the lemniscate mechanism has been avoided. Prior art dimensioning of the lemniscate mechanism was based on the entire roof support be overturned when subjected to excessive lateral loads with the prior art, deformation of individual structural components could not be checked.

With the roof-support design of the present invention, the erection strut, as in prior-art designs, can be designed as a thrust-piston device with controlled hydraulic links so as to permit controlled slewing.

In a preferred further development of the roof support of the invention, its design is such that the upper link of the lemniscate mechanism, which is articulated to an erection strut, has a smaller cross-section and/or a region of lower bending strength located above the articulation point. Such a design also enables state-of-the-art roof supports, such as the roof support in AT-PS 379 215, to be easily retrofitted to achieve the benefits of the present invention.

Advantageously, at least one link of the lemniscate mechanism can be designed with a bend angle such as a right angle in it. With such a design, an enlarged space to receive the erection strut is created between the links of the lemniscate mechanism when the props are retracted. Such a design is advantageous because lemniscate mechanism links with a predetermined bending point are usually designed to be flat in the region of the predetermined bending point, that is, their width in this region exceeds their height (considered from the viewpoint of the longitudinal direction of the link). To ensure transmission of excessive slewing forces into the region of the bending point, it is advantageous for the design to be such that the upper link of the lemniscate mechanism has a bend in it in the region of its articulation to the erection strut.

The incorporation of an accurately predetermined bending member effectively excludes the possibility of deformation of the other structural components, and deformation of a predetermined bending member is easy to observe so the deformed part can be replaced at the right time.

BRIEF DESCRIPTION OF THE DRAWINGS

The invention will now be described in greater detail with reference to an example of an embodiment shown, in which.

In the drawings.

DETAILED DESCRIPTION OF THE INVENTION

Figure 1:
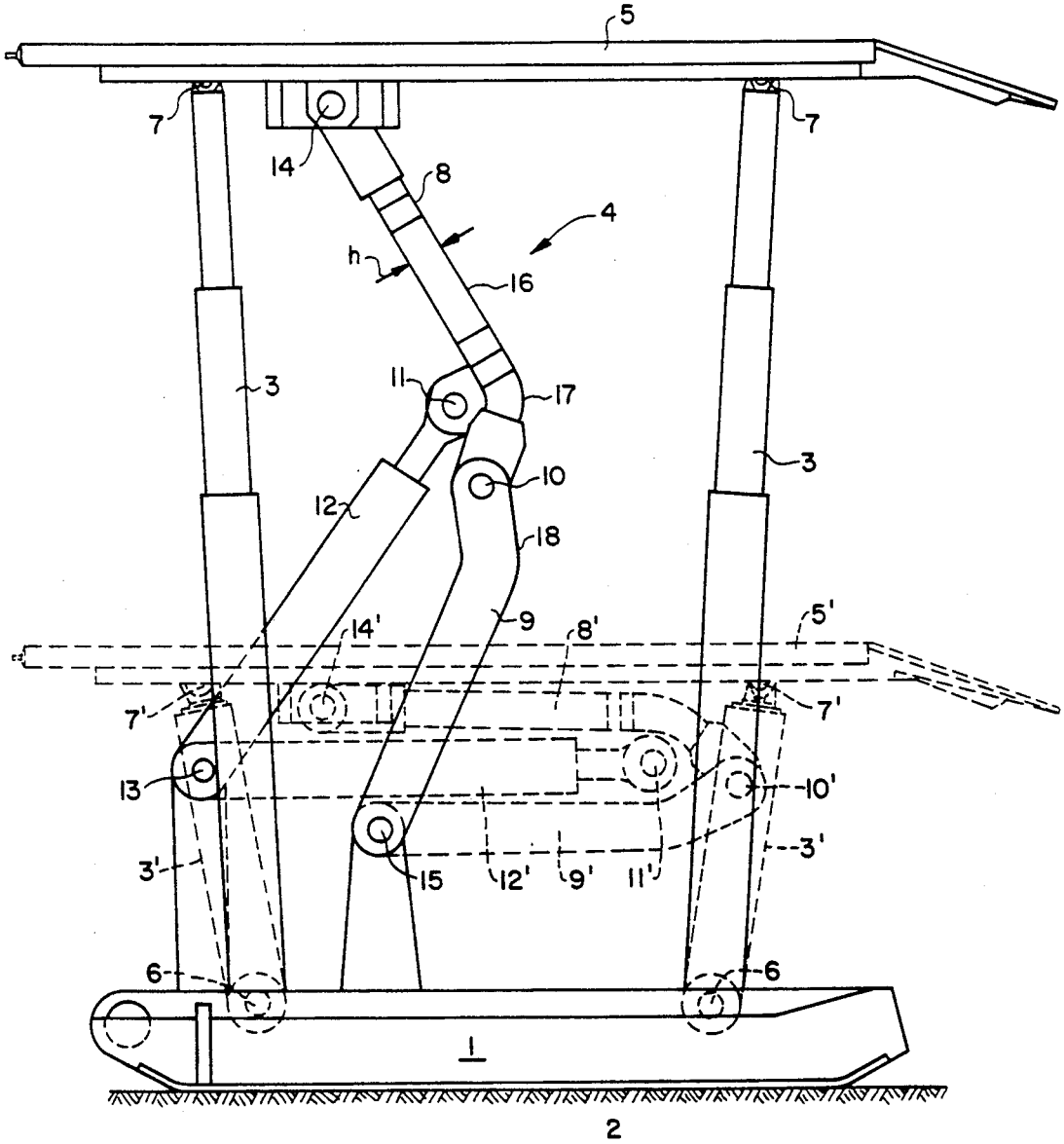
FIG. 1 shows a side view of a roof support according to the invention.

The roof support has a base frame 1, which can be moved on, e.g., runners or caterpillar tracks 2. Hydraulically telescoping props 3, each with a number of sections, are connected to the four corners of the rectangle framed by the base frame 1, and there is a lemniscate mechanism 4 between the base frame 1 and the roof bar 5. The props 3 are articulated to both the base frame 1 and the roof bar 5, and their respective articulations 6 and 7 can be ball and socket joints, for example. The props are essentially vertical, being inclined only slightly outwards, and they operate in conjunction with the lemniscate mechanism 4, ensuring that the roof bar 5 moves in a largely vertical direction as the props are extended. Furthermore, the essentially vertical arrangement of the props 3 means that when the roof bar 5 is horizontally displaced, which could occur as a result of rock movement in the roof, this displacement produces only an insignificant change in the vertical distance between the roof bar 5 and the base frame, and results in only slight tilting of the roof bar 5.

The lemniscate mechanism consists of an upper link 8 and a lower link 9, which are articulated to each other at 10. An erection strut 12, consisting of, for example, a hydraulic cylinder and piston unit, is articulated to the upper link of the lemniscate mechanism 8 at 11, and is articulated to the base frame 1 at 13. The upper link 8 of the lemniscate mechanism is connected to the roof bar 5 by means of, for example, a universal joint 14, so that it can be swivelled to all sides. The lower link 9 of the lemniscate mechanism is articulated to the base frame at 15. Articulation points 10, 11, 13, and 15 are essentially laterally rigid and therefore, as a result of the wide, flat design of the links 8 and 9, the whole lemniscate mechanism 4 forms an essentially laterally-rigid unit in a plane perpendicular to the plane of the links 8 and 9 of the lemniscate mechanism.

In order to be able to avoid uncontrolled deformation of individual structural components or overturning of the entire roof support when it is subjected to overload conditions while in the extended position, the upper link 8 of the lemniscate mechanism has a predetermined bending point 16 on it. In the example shown here, the cross-section of the essentially flat upper link is reduced to width b in region 16, as can be clearly seen in FIG. 2. Width b exceeds the depth h of the upper link 8, so that, when an overload occurs, the upper link 8 of the lemniscate mechanism displays a predetermined bending behaviour. Alternatively, or in addition to the reduced cross-section, the bending characteristics in the region of the predetermined bending point 16 can be altered by an appropriate choice of material.

Figure 2:
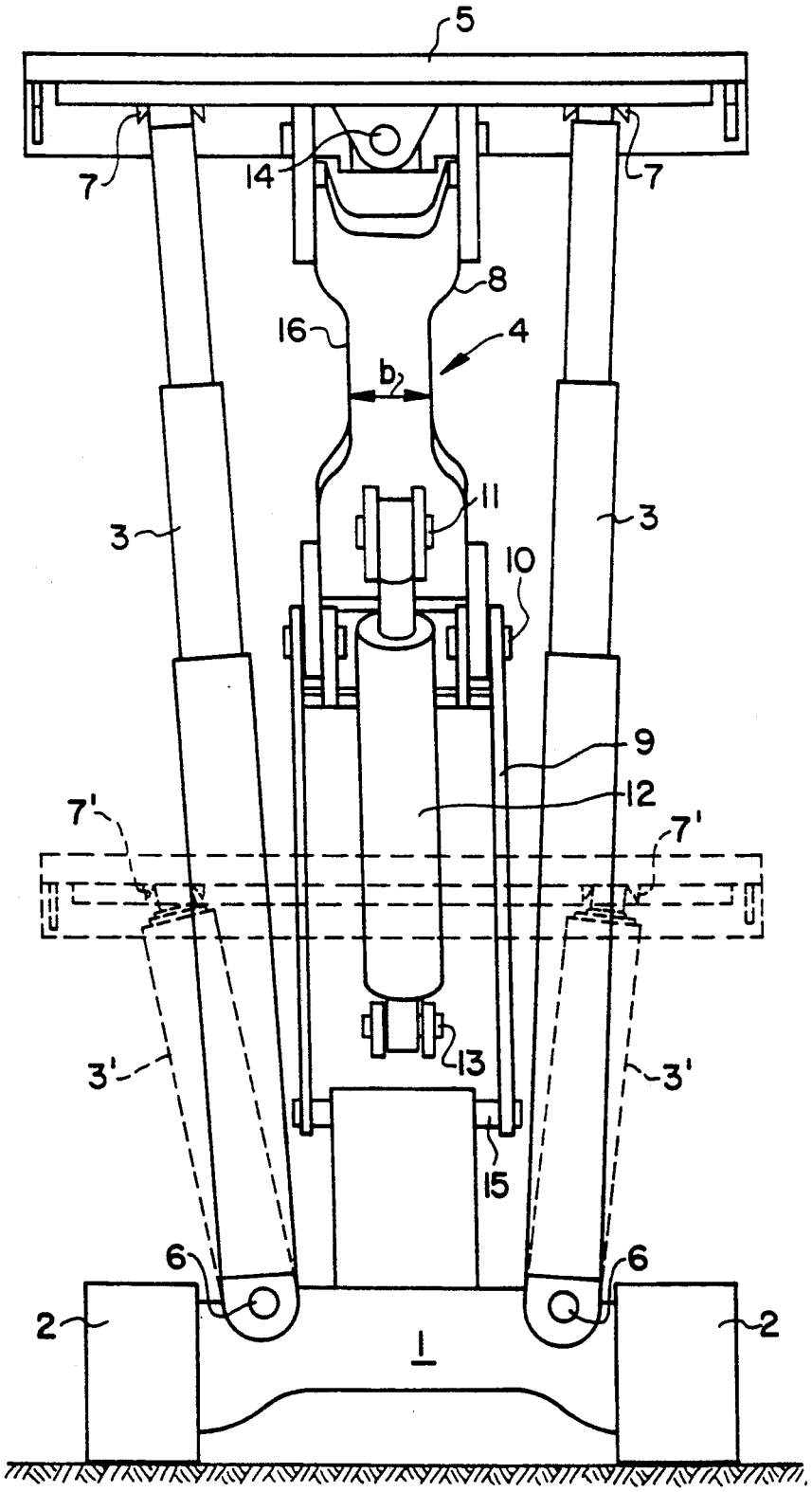
FIG. 2 shows a view of the same roof support in the direction of arrow II in FIG. 1.

Due to the provision of a predetermined bending point on at least one of the links 8, 9 of the lemniscate mechanism, the rest of the structure can be designed to be more stable, and when a load occurs that causes deformation of the link with the predetermined bending point, it is merely necessary to replace the deformed link, while the other structural components, and particularly the articulations, remain undamaged. To provide a transport position that is as low as possible, even when suitably substantial links and joints are used, the links 8 and 9 are designed with a bend or right angle in the region of the articulation point, as indicated at 17 and 18. This gives a low transport height when the props 3 are lowered, without individual parts of the lemniscate mechanism having to be relieved or offset to enable other parts to at least partially fit between them. The lowered position is indicated by broken lines in FIGS. 1 and 2. In FIG. 2, for the sake of clarity, only the props 3' and the roof bar 5' are depicted in the lowered position.

What is claimed is:

1. A support for supporting the roof and shielding the caving area in underground excavations, and particularly for waste-edge support in pillar extraction in coal mines, said support comprising:

a base frame;

a roof bar braced against said base frame by means of hydraulically extendable props and a lemniscate mechanism, the props being articulated to the base frame and the roof bar;

wherein at least one link of the lemniscate mechanism is provided with a predetermined bending point.

2. A support as claimed in claim 1, further comprising:

an erection strut; wherein the lemniscate mechanism has an upper link articulated to said erection strut at an articulation point, said upper link having a cross-section of reduced size located above said articulation point.

3. A support as claimed in claim 1, further comprising:

an erection strut; wherein the lemniscate mechanism has an upper link articulated to said erection strut at an articulation point, said upper link having a region of lower bending strength located above said articulation point.

4. A support as claimed in claim 1, further comprising:

an erection strut; wherein the lemniscate mechanism has an upper link articulated to said erection strut at an articulation point, said upper link being substantially comprised of a first material and having a region being comprised of a second material located above said articulation point.

5. A support as claimed in any one of claim 1, 2, 3 or 4, wherein at least one link of the lemniscate mechanism has a bend angle.

6. A support as claimed in claim 5, wherein said bend angle is a right angle.

7. A support as claimed in claim 5, wherein said bend angle is located proximate to said articulation point.

8. A support as claimed in claim 5, wherein said bend angle is a right angle.

* * * * *